US005775978A

United States Patent [19]

Brocksieper et al.

[11] Patent Number: 5,775,978

[45] Date of Patent: Jul. 7, 1998

[54] METHOD FOR THE FINE MACHINING OF PISTON RINGS AND APPARATUS FOR CARRYING OUT SAME

[75] Inventors: Manfred Brocksieper, Hückeswagen; Eberhard Schneider, Solingen, both of Germany

[73] Assignee: AE Goetze GmbH, Burscheid, Germany

[21] Appl. No.: 683,217

[22] Filed: Jul. 18, 1996

[30] Foreign Application Priority Data

Jul. 22, 1995 [DE] Germany ..... 195 26 863.6

[51] Int. Cl.[6] ..... B24B 1/00

[52] U.S. Cl. ..... 451/51; 451/49; 451/302; 451/303

[58] Field of Search ..... 451/49, 50, 51, 451/302, 303, 168, 170, 173; 29/888.75, 888.76, 888.07

[56] References Cited

U.S. PATENT DOCUMENTS

| | | |
|---|---|---|
| 2,318,837 | 5/1943 | Connor . |
| 2,376,531 | 5/1945 | Egger . |
| 3,296,747 | 1/1967 | Philippsen et al. . |
| 4,330,963 | 5/1982 | Wada et al. . |

FOREIGN PATENT DOCUMENTS

| | | |
|---|---|---|
| 0 219 301 | 4/1987 | European Pat. Off. . |
| 30 11 670 | 10/1987 | Germany . |

*Primary Examiner*—Timothy V. Eley
*Assistant Examiner*—Derris H. Banks
*Attorney, Agent, or Firm*—Spencer & Frank

[57] ABSTRACT

A method and tool for fine machining an outside circumferential surface of radially outwardly expanded, ring-shaped workpieces having respective holes therein, the workpieces being combined to form a stack. The tool includes a clamping arrangement for clamping the stack; a pair of segments disposed adjacent the clamping arrangement, each of the segments having a segment surface defining a predetermined radius of curvature corresponding approximately to a nominal radius of curvature of each of the workpieces; and a grinding belt arrangement disposed adjacent the segment surfaces. The segments are moved into a processing position wherein the radii of curvature of respective ones of the segment surfaces share a common center point, the step of moving the segments including the step of advancing the segments toward the stack such that the grinding belt arrangement is brought into grinding contact with the stack and thereby assumes a contour of the segment surfaces. The stack is thereafter moved relative to the grinding belts. The segments are kept in their processing position during the step of moving the stack.

11 Claims, 1 Drawing Sheet

METHOD FOR THE FINE MACHINING OF PISTON RINGS AND APPARATUS FOR CARRYING OUT SAME

FIELD OF THE INVENTION

The invention relates to a method for fine machining the outer peripheral surface of radially outwardly expanded, ring-shaped work pieces defining a gap therein, and, in particular of piston rings that are combined to form a stack. The stack is formed by means of a tool which spans the work pieces and which comprises at least two segments. The segments each have a surface defining a radius of curvature against which the work pieces fit themselves with their outer peripheral surfaces and relative to which they can be moved.

BACKGROUND OF THE INVENTION

Until now, piston rings have been combined to form a stack for fine machining, and their outer peripheral surfaces have been processed inside a honing sleeve in such a way that a mandrel with piston rings fitted over it is inserted into the sleeve and is moved back and forth as well as rotated therein. DE 30 11 670 discloses an apparatus such as the one described above, where the honing sleeve has a cylindrical cross-section. The inside diameter corresponds in this case to the diameter of the piston rings during operation. The honing sleeve has a slightly conical taper on the inside of its upper area. The piston rings are pushed into the honing sleeve by way of this tapered area. The honing sleeve comprises two halves and is braced with screws which serve to readjust the contact pressure force of the right half of the sleeve against the left half of the sleeve. The contact pressure force must be readjusted, depending on the wear of the honing sleeve. The disadvantage of the above apparatus is that once the contact pressure force is readjusted, the inside bore diameter is no longer circular. The wear of honing sleeves is a particular problem for processing piston rings. Owing to the great wear and tear of the inside bore of the honing sleeves, a plurality of sleeves must be provided. The readjustment of honing sleeves has not proven advisable with respect to the quality requirements of modern engines. In addition, the watery or oily lapping agents used in conjunction with honing sleeves result in high disposal costs.

SUMMARY OF THE INVENTION

It is the object of the invention to overcome the disadvantages associated with apparatuses of the prior art and to create a new fine machining method which permits achieving surface topographies for the piston rings which improve their operational characteristics. The solution according to the invention is that the segments of the grinding tool are initially advanced toward the work pieces in such a way that a grinding belt, which adjusts to the outer peripheral surfaces of the piston rings, is brought in grinding contact with these surfaces, and that the radii of curvature for the segment surfaces of the grinding tool have a common center point in the processing position. Subsequently, the work pieces are moved relative to the grinding belt, wherein the adjusted processing position for the segments is kept constant during fine machining.

The processing of the outer peripheral surfaces of the piston rings with the aid of a grinding belt has been known for many years, and concerns a method for fine machining cylindrical and curved surfaces by using a polishing band as a cutting means. True to form polishing trays, which themselves are not subject to wear and tear because they are outside of the material cutting range, press the polishing band against the work piece surface. U.S. Pat. No. 2,376,531 discloses an apparatus such as the one described above. The method according to the invention is based on a similar apparatus. However, according to the invention, no pressure is exerted by the tool on the work pieces. Thus, the invention makes it possible to process the outside circumference of even radially outwardly expanded work pieces defining a gap therein, in particular of piston rings. The prior art permits the processing of only endless, rigid work pieces. Owing to the fact that the radii of curvature of the segment surfaces share a common center point which is kept fixed throughout the total processing operation, a closed, locked processing tool is created which serves to guide and process the work pieces. The specific contact pressure is generated by the expansion of the work pieces in between the segments. The work pieces are preferably moved back and forth and are rotated by means of disks arranged at the end areas of the stack, wherein it is particularly advantageous that the work pieces in the stack move with axial play, so that each individual work piece fits itself against the grinding belt by expanding in between the segments. The disks transfer their rotational movement to the work pieces. In this case, the transfer of the rotational movement is triggered at the dead centers for the axial back and forth movement. The transfer of the rotational movement to the individual work pieces within the stack takes place through the frictional forces between the individual work pieces. It is also conceivable to have a planned axial compression and decompression of the work pieces during processing thereof in order to introduce a forced, periodic rotation and thus create a specific grinding surface. For example, the relative speed of the individual movements can be selected such that a crosshatching with a predeterminable angle of crossing and a peak-to-valley height $R_z$ smaller than 3 μm is generated on the ground surfaces. In order to produce a spherically turned outside peripheral surface, a wobbling movement may further be introduced during the back and forth movement.

To carry out the method according to the invention, it is suggested that the tool be composed of two segments, for which the radius of curvature corresponds approximately to that of a work piece expanded to the nominal diameter and which has a grinding belt arranged on its surface. The segments can be advanced radially toward the stack via a guide and can be locked in place with fastening means once the processing position is reached. Since the stack is inserted into the opened processing station, the otherwise standard stack intake via an inserting cone is not necessary. As a result of the above, breaks along the edges of the work pieces can be avoided. Thus, the amount of discarded material is lowered and the quality improved. The disks can be adjusted to a pivoting angle with an adjustment mechanism that acts upon the disks. This adjustment can be changed during the processing. It would also be conceivable to use a design where the disks are locked in one position and the processing station can swivel, or to use disks with slanted plane faces.

BRIEF DESCRIPTION OF THE DRAWINGS

The foregoing objects of the invention, together with other objects and advantages which may be attained by its use, will become more apparent upon reading the following detailed description of the invention taken in conjunction with the drawing, which depicts an exemplary embodiment of the invention.

DETAILED DESCRIPTION OF THE INVENTION

Figure 1:
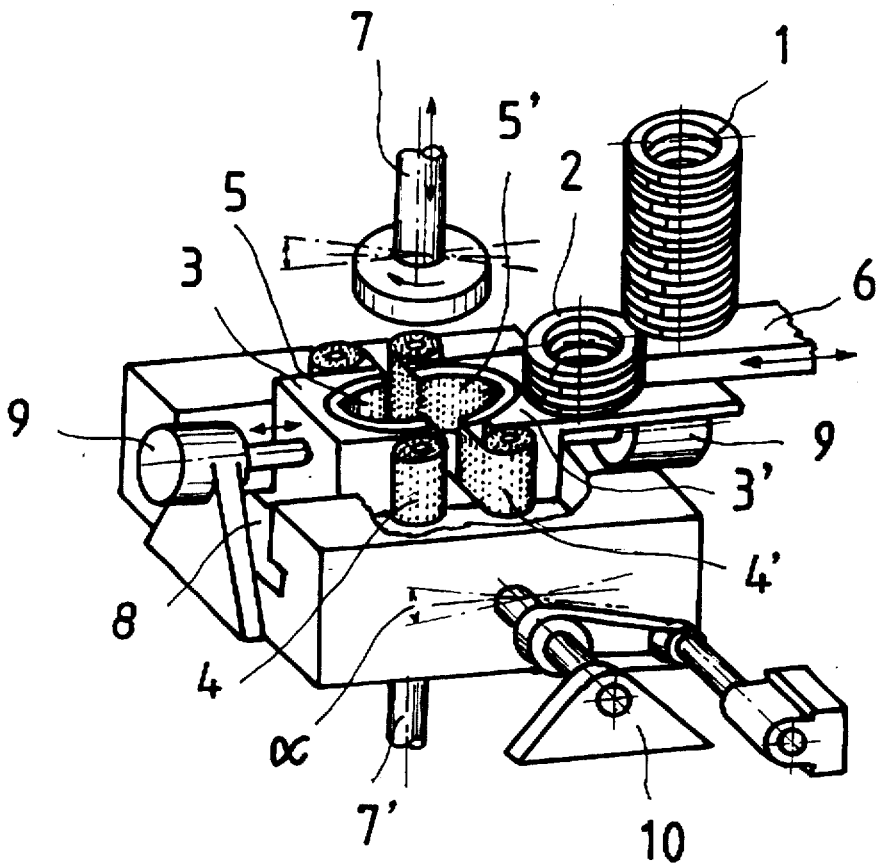

In order to carry out the method according to the invention for fine machining piston rings 1 combined to form a stack 2, a tool including two segments 3, 3' is provided. The tool has a grinding belt 4 on the inside circumference thereof. The radius of curvature of the surfaces 5, 5' of segments 3, 3', respectively corresponds to that of a piston ring 1 expanded to a nominal diameter. For fine machining stack 2, piston rings 1 are supplied to segments 3, 3' in the form of stack 2 with the aid of a slider 6. With the aid of disks 7, 7', which act upon the end areas of the stack 2, the stack 2 is moved between the segments 3, 3' either loosely or while compressed in an axial direction. The segments 3, 3' are moved by means of a guide 8 radially toward stack 2 when it is held between disks 7, 7'. Upon reaching the processing position, that is as soon as the radii of curvature of surfaces 5, 5' share a common center point, segments 3, 3' are locked in place with fastening means 9, which may for example comprise hydraulic cylinders. For fine machining the outside circumferential surface of the individual piston rings 1, the pistons are moved axially back and forth between segments 3, 3' and are rotated. At the same time, a swiveling angle α can be adjusted for the wobbling movement with an adjustment mechanism 10. In contrast to fine machining accomplished through the use of honing sleeves, material is removed by means of an abrasive grain on a grinding belt when using the method according to the invention. The grinding belt 4 can be supplied continuously from a roll and in cycles so that an even material removal is ensured at all times.

We claim:

1. A method for fine machining an outside circumferential surface of radially outwardly expanded, ring-shaped workpieces having respective holes therein, the workpieces being combined to form a stack, the method comprising the steps of:

utilizing a fine machining tool including:

clamping means for clamping the stack;

a pair of segments disposed adjacent the clamping means, each of the segments having a segment surface defining a predetermined radius of curvature corresponding approximately to a radius of curvature of each of the workpieces expanded to a nominal diameter; and grinding belt means disposed adjacent the segment surfaces;

moving the segments into a processing position wherein the radii of curvature of respective ones of the segment surfaces share a common center point, the step of moving the segments including the step of advancing the segments toward the stack such that the grinding belt means is brought into grinding contact with the stack and thereby assumes a contour of the segment surfaces;

moving the stack relative to the grinding belts after the step of moving the segments into their processing position; and keeping the segments in their processing position during the step of moving the stack.

2. The method according to claim 1, wherein:

the clamping means include a pair of disks adapted to clamp respective ends of the stack; and the step of moving the stack comprises the step of utilizing the pair of disks to effect a back and forth movement of the stack in a direction along a longitudinal axis thereof and to effect a rotational movement of the stack about the longitudinal axis thereof.

3. The method according to claim 2, wherein the step of utilizing the pair of disks includes the step of triggering a transfer of rotational movement to the stack at dead center positions for the back and forth movement of the stack.

4. The method according to claim 3, wherein the step of triggering includes the step of utilizing respective ones of the disks at each of the dead center positions for transferring the rotational movement to the stack.

5. The method according to claim 2, wherein the step of moving the stack comprises the step of controlling an axial compression and decompression of the pair of disks for effecting a predetermined movement of the workpieces.

6. The method according to claim 2, wherein the step of moving the stack comprises the step of controlling relative speeds of the back and forth movement and of the rotational movement of the stack such that a cross-hatching having a peak-to-valley height of $R_z$ smaller than 3 microns is produced on the outer circumferential surface of the stack.

7. The method according to claim 2, wherein the step of moving the stack further comprises the step of imparting a swivelling movement to the stack during the back and forth movement and the rotational movement of the stack thereby producing a stack having a spherical outside circumferential surface.

8. The method according to claim 1, wherein the step of moving the stack includes the step of moving the stack back and forth in a direction along a longitudinal axis of the stack while the grinding belt means is in grinding contact with the stack by virtue of a radial expansion of each workpiece in between the segments.

9. A fine machining tool for fine machining an outside circumferential surface of radially outwardly expanded, ring-shaped workpieces having respective holes therein, the workpieces being combined to form a stack, the tool comprising:

clamping means for clamping the stack, the clamping means including means for imparting a swivelling movement to the stack;

a pair of segments disposed adjacent the clamping means, each of the segments having a segment surface defining a predetermined radius of curvature corresponding approximately to a radius of curvature of each of the workpieces expanded to a nominal diameter;

grinding belt means disposed adjacent the segment surfaces;

means for moving the segments into a processing position wherein the radii of curvature of respective ones of the segment surfaces share a common center point, the means for moving including a means for advancing the segments toward the stack such that the grinding belt means is brought into grinding contact with the stack and thereby assumes a contour of the segment surfaces, the clamping means being effective for moving the stack relative to the grinding belts after the segments have been moved into their processing position; and means for keeping the segments in their processing position while the stack is being moved.

10. The tool according to claim 9, wherein:

the means for advancing the segments comprises a guide configured to advance the segments toward the stack in a direction along a radius of the stack; and the means for keeping comprises a fastening means for locking the segments in their processing position.

11. The tool according to claim 9, wherein:

the clamping means comprise a pair of disks adapted to clamp respective ends of the stack; and the means for imparting comprises an adjustment mechanism for swivelling the disks within a swivel angle α.

* * * * *